US006084361A

United States Patent [19]

Wacyk

[11] Patent Number: 6,084,361

[45] Date of Patent: Jul. 4, 2000

[54] DISCHARGE LAMP OPERATING CIRCUIT WITH ON TIME CONTROL OF SWITCHING TRANSISTOR

[75] Inventor: Ihor T. Wacyk, Briarcliff Manor, N.Y.

[73] Assignee: U.S. Philips Corporation, New York, N.Y.

[21] Appl. No.: 09/022,128

[22] Filed: Feb. 11, 1998

[30] Foreign Application Priority Data

Feb. 13, 1997 [EP] European Pat. Off. ..... 97200406

[51] Int. Cl.[7] ..... G05F 1/00

[52] U.S. Cl. ..... 315/291; 315/307; 315/209 R; 315/244; 315/DIG. 5; 315/DIG. 7

[58] Field of Search ..... 315/291, 307, 315/209 R, 244, DIG. 2, DIG. 5, DIG. 7; 362/265, 221; 313/318

[56] References Cited

U.S. PATENT DOCUMENTS

| | | | |
|---|---|---|---|
| 4,373,146 | 2/1983 | Bonazoli et al. | 315/209 |
| 4,677,345 | 6/1987 | Nilssen | 315/209 R |
| 5,365,151 | 11/1994 | Spiegel et al. | 315/209 R |
| 5,410,221 | 4/1995 | Mattas et al. | 315/307 |
| 5,414,327 | 5/1995 | Reijnaerts | 315/219 |
| 5,528,117 | 6/1996 | Buij et al. | 315/224 |
| 5,550,722 | 8/1996 | Bouwman et al. | 362/221 |

FOREIGN PATENT DOCUMENTS

| | | |
|---|---|---|
| 0386990A2 | 9/1990 | European Pat. Off. . |
| 0323676B1 | 12/1993 | European Pat. Off. . |

*Primary Examiner*—Haissa Philogene
*Attorney, Agent, or Firm*—Bernard Franzblau

[57] ABSTRACT

A circuit arrangement for supplying a discharge lamp, comprising a converter for generating a high-frequency current with a frequency f from a supply voltage. The converter comprises at least one switching element which is rendered alternately conducting and non-conducting at the frequency f while the discharge lamp is being supplied. In addition a circuit portion I is provided for the low-frequency modulation of the power consumed by the discharge lamp through an adjustment of the conduction period of the switching element. As a result, instabilities in the discharge lamp plasma, such as striations and moding, are suppressed to a considerable degree.

15 Claims, 2 Drawing Sheets

DISCHARGE LAMP OPERATING CIRCUIT WITH ON TIME CONTROL OF SWITCHING TRANSISTOR

BACKGROUND OF THE INVENTION

This invention relates to a circuit arrangement for supplying a discharge lamp, comprising a converter for generating a high-frequency current at a frequency f from a supply voltage, which converter comprises at least one switching element which is rendered alternately conducting and non-conducting at the frequency f while the discharge lamp is being supplied.

The invention also relates to a compact fluorescent lamp.

That circuit arrangement is known from EP 0323676 A1. Such a circuit arrangement is particularly suitable for supplying low-pressure mercury discharge lamps. The frequency f is often chosen to be of the order of 10 kHz in the case of low-pressure mercury discharge lamps. A major advantage of the high-frequency supply of such discharge lamps is, for example, the comparatively high luminous efficacy (lm/W).

A disadvantage of the high-frequency operation of low-pressure mercury discharge lamps, however, is that instabilities can arise in the discharge, which may give rise to the occurrence of, for example, striations or moding. The term "moding" is here understood to mean a low-frequency fluctuation of the luminous flux of the discharge lamp.

SUMMARY OF THE INVENTION

It is an object of the invention to provide a circuit arrangement with which it is possible to supply a discharge lamp with high frequency current while instabilities in the discharge such as striations and moding are suppressed to a considerable degree.

According to the invention, a circuit arrangement of the kind mentioned in the opening paragraph is for this purpose characterized in that the circuit arrangement is provided with a circuit portion I for the low-frequency modulation of the power consumed by the discharge lamp through an adjustment of the conduction period of the switching element. The conduction period of the switching element is here understood to be the time interval during which the switching element conducts current. This invention features "transistor conduction time" ($T_{on}$) control of the converter in contrast to frequency control which is available in certain prior art discharge lamp converter circuits. The low-frequency modulation of the power consumed by the discharge lamp causes a low-frequency modulation of the luminous flux of the discharge lamp. Given a suitable choice of the modulation frequency, the luminous flux of the discharge lamp is perceived by the human eye as being constant at a level which is equal to the average value of the luminous flux over a cycle of the low-frequency modulation. It was found that instabilities in the discharge are suppressed to a considerable degree by the low-frequency modulation of the conduction period of the switching element. The conduction period is the $T_{on}$ time of the switching element operating at the high frequency, not the on-time of the low frequency square wave used to modulate the converter.

The low-frequency modulation is preferably of the square-wave type. In this case the circuit portion I comprises means for alternately and with low frequency setting the power consumed by the discharge lamp for a first value through adjustment of the conduction period of the switching element during a first time interval and setting the power consumed by the discharge lamp for a second value through adjustment of the conduction time of the switching element during a second time interval. Such a low-frequency modulation can be realized with comparatively inexpensive and simple means. If circuit portion I is provided with means for adjusting the duty cycle of the square-wave modulation, it is possible to adjust the luminous flux of the discharge lamp by these means.

It is possible to change the conduction period of the switching element while the value of the frequency f remains the same. Often, however, the construction of the circuit arrangement is such that a change in the conduction period of the switching element also leads to a change in the frequency f.

It is possible to realize the setting of the power consumed by the discharge lamp during each of the two time intervals in that the conduction period is set for a fixed, predetermined value. This approach is often referred to as feedforward. An improvement in the operation of the circuit arrangement, however, can be achieved through the use of a power control. A comparatively simple and reliable power control can be realized in that the circuit arrangement is provided with a power control mechanism for controlling the power consumed by the discharge lamp at a substantially constant value through the adjustment of the conduction period. This power control controls the first value of the power consumed by the discharge lamp at a first substantially constant value P1 through adjustment of the conduction period of the switching element during the first time interval, and controls the second value of the power consumed by the discharge lamp at a second substantially constant value P2 through adjustment of the conduction period during the second time interval. It was found that such a power control provides an important further contribution to the suppression of instabilities in the plasma of the discharge lamp.

Good results were obtained with a circuit arrangement according to the invention in which the converter comprises a bridge circuit.

The circuit arrangement according to the invention was found to be highly suitable for supplying the comparatively thin low-pressure mercury discharge lamps which are used, for example, in an LCD backlight.

A circuit arrangement according to the invention is also highly suitable for supplying a compact fluorescent lamp. In that case the circuit arrangement is preferably incorporated in the space surrounded by a housing which is connected to the discharge vessel and is provided with a lamp cap.

BRIEF DESCRIPTION OF THE DRAWING

The invention will be explained in more detail with reference to a drawing, in which.

DESCRIPTION OF THE PREFERRED EMBODIMENTS

Figure 1:
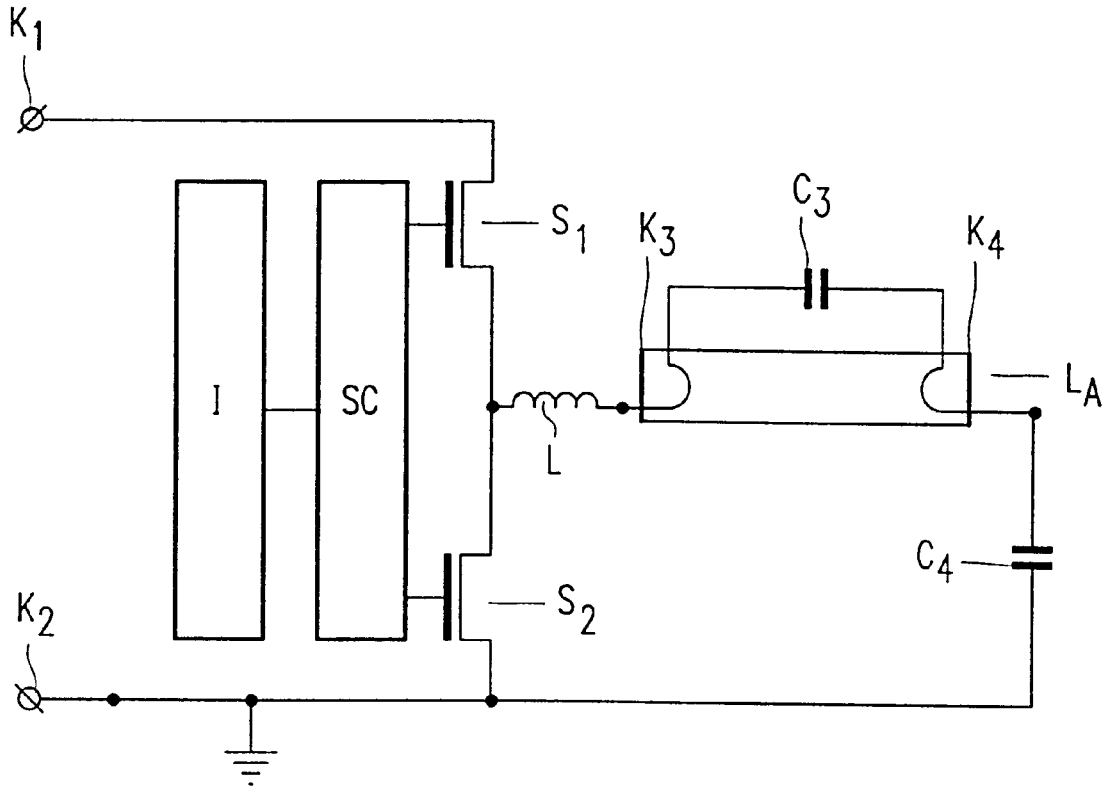
FIG. 1 is a diagram of an embodiment of a circuit arrangement according the invention.

In FIG. 1, K1 and K2 are terminals for connection to a supply voltage source. This supply voltage source is a DC voltage source in the embodiment shown in FIG. 1. Terminals K1 and K2 are interconnected by a series arrangement of two switching elements S1 and S2. Each of the switching elements S1 and S2 is a FET having a respective inherent reverse diode D1 and D2 (not shown). SC is a circuit portion for generating a control signal for rendering the switching elements S1 and S2 alternately conducting at a frequency f. A first and a second output of circuit portion SC are for this purpose coupled to a control electrode of switching element S1 and to a control electrode of switching element S2, respectively. I is a circuit portion for the low-frequency square-wave modulation of the conduction periods of the two switching elements. Preferably, the circuit portion I is also provided with means for adjusting the duty cycle of the low-frequency square-wave modulation. An output of circuit portion I is coupled to an input of circuit portion SC. Switching element S2 is shunted by a series arrangement of an inductive element L, terminals K3 and K4 for connecting a discharge lamp, and a capacitor C4. A discharge lamp La is connected to the terminals K3 and K4. The discharge lamp La is shunted by a capacitor C3. The brightness level of the lamp is controlled by modulating or switching the switching elements at a low frequency between two different values of conduction time for switch $S_2$, and switch $S_1$, which may or may not be equal to $S_2$.

The operation of the circuit arrangement shown in FIG. 1 is as follows.

When the terminals K1 and K2 are connected to a supply voltage source, the circuit portion SC will render the switching elements S1 and S2 alternately conducting and non-conducting in turn at the frequency f. As a result of this, a high-frequency current with frequency f flows through the discharge lamp. Each switching element is rendered conducting by the circuit portion SC, subsequently conducts a current during a time interval Ton, and is rendered non-conducting at the end of the time interval Ton. The load circuit including the discharge lamp is predominantly inductive so that when a switching element is driven into non-conductive, the load current cannot instantaneously turn off. After a switching element has been rendered non-conducting, the high-frequency current will be redirected so as to flow through a diode (not shown) which forms a part of the other switching element. The other switching element is rendered conducting before the current through the diode has become equal to zero. This other switching element will conduct current after the current through the diode has become zero. Thus, the total time that current flows through switch $S_2$ consists of the sum of the time in which the reverse current flows through its inherent reverse diode and the forward conduction time $T_{on}$ of the FET $S_2$. It has been observed, particularly when dimming a low pressure discharge lamp, that instability will occur in a system that uses frequency control because at any particular frequency, different combinations of diode on time and FET forward conduction time ($T_{on}$) can exist corresponding to different values of lamp power. When $T_{on}$ control is employed, lamp stability is improved since one value of $T_{on}$ corresponds to one value of lamp power. The conduction periods of the switching elements are modulated into a square-wave shape with low-frequency by the circuit portion I. As a result of this, the power consumed by the discharge lamp alternately has the comparatively high value P1 during to a conduction period Ton1 during a time interval Δt1, and the comparatively low value P2 during a conduction period Ton2 during a time interval Δt2. A signal which is a measure for the power consumed by the discharge lamp is generated by means not shown in FIG. 1 both during the time interval Δt1 and during the time interval Δt2. This signal is compared with a signal which is a measure for a desired value of the power consumed by the discharge lamp, and depending on the outcome of this comparison the conduction periods of the switching elements are adjusted such that the power consumed by the discharge lamp is substantially constant in each of the two time intervals. The power control, which is active both during the time interval Δt1 and during the time interval Δt2, corresponds to the power control implemented in the Philips HF Regulator ballast, which for this purpose is provided with the UBA 2010 T IC. An improved stability of the discharge in the discharge lamp is realized thanks to this additional power control during both time intervals. The lamp power is controlled by adjusting the ratio of the FET forward conduction time $T_{on}$ to the reverse conduction time of the FET reverse (body) diode at a particular frequency value of the high frequency current.

The average power Pav consumed by the discharge lamp is in theory:

$$Pav = \frac{\Delta t1 * P1 + \Delta t2 * P2}{\Delta t1 + \Delta t2}$$

This average power Pav consumed by the discharge lamp, and accordingly also the luminous flux of the discharge lamp, can be adjusted in that the ratio of Δt1 to Δt2, i.e. the duty cycle of the square-wave modulation, is adjusted.

Figure 2:
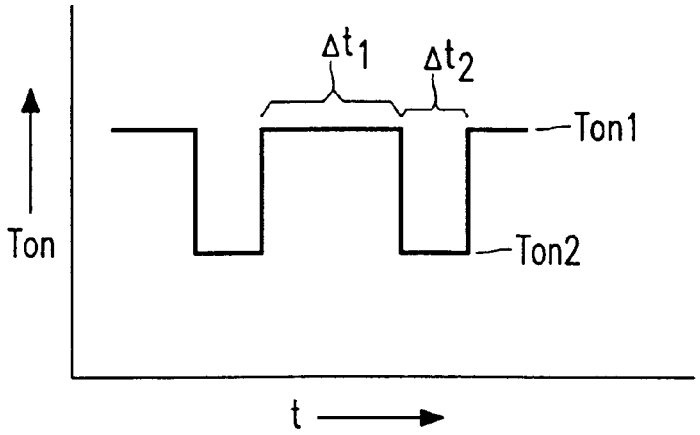
FIG. 2 shows the conduction period of each of the two switching elements forming part of the circuit arrangement shown in FIG. 1 as a function of time.

FIG. 2 shows time plotted in arbitrary units on the horizontal and the vertical axis. The square-wave curve shows the conduction periods of the switching elements of the converter in a circuit arrangement as shown in FIG. 1 as a function of time. It is apparent that the conduction period Ton has a value Ton1 during a time interval Δt1 and a value Ton2 during a time interval Δt2.

Figure 3:
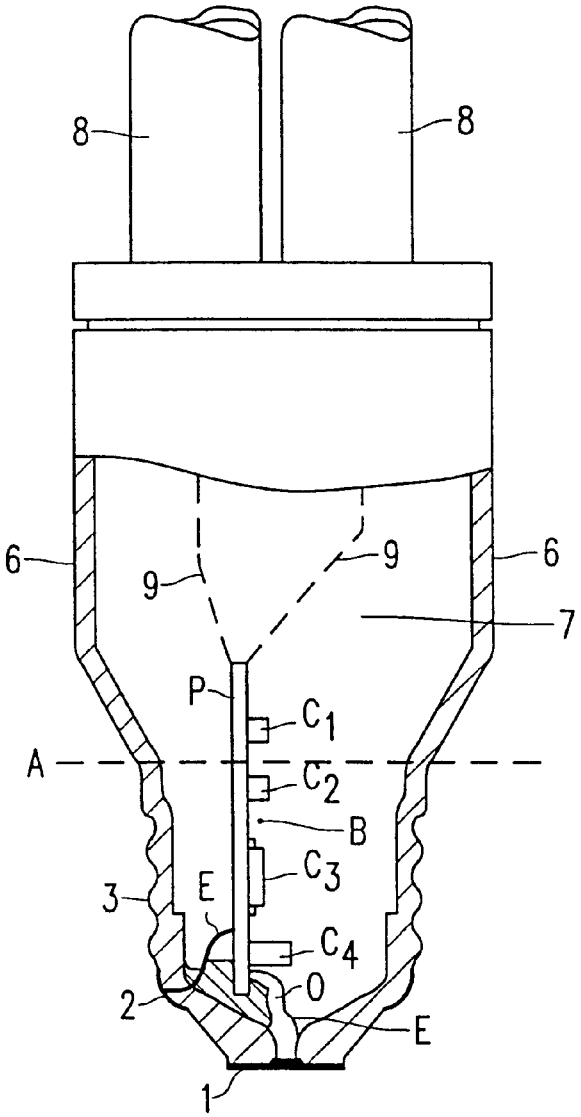
FIG. 3 shows part of a compact fluorescent lamp provided with a circuit arrangement according to the invention.

FIG. 3 shows a portion 8 of a discharge vessel which is sealed in a gastight manner and which transmits radiation. The wall 6 of a housing is connected to the discharge vessel 8 and provided with a lamp cap 3, a circuit arrangement B according to the invention being present in a space 7 surrounded by said housing. The circuit arrangement is diagrammatically represented by the components P and C1 to C4. Connection wires between the circuit arrangement and electrodes (not shown) in the discharge vessel have the reference numeral 9. E indicates connection wires between the circuit arrangement and electrical contacts 1 and 2 placed on the lamp cap. It is possible to adjust the duty cycle of the square-wave modulation of the frequency f of the lamp current by means which are not shown in FIG. 3 and which are accommodated outside the housing.

I claim:

1. A circuit arrangement for supplying a discharge lamp, comprising: a converter for generating a high-frequency current with a frequency f from a supply voltage, wherein the converter comprises at least one switching element which is rendered alternately conducting and non-conducting at the frequency f while the discharge lamp is being supplied, characterized in that the circuit arrangement is provided with a circuit portion (I) for the low-frequency square wave modulation of the power consumed by the discharge lamp and including means for adjusting the conduction period of the switching element.

2. A circuit arrangement as claimed in claim 1 wherein the switching element is a field effect transistor having an inherent reverse diode which conducts a reverse current during a part of each cycle of the high frequency current, and wherein said adjusting means controls the ratio of the field effect transistor forward conduction time ($T_{on}$) to its reverse diode conduction time in a cycle of the high frequency current.

3. A circuit arrangement as claimed in claim 1 wherein the circuit portion (1) includes means for adjusting the duty cycle of the square-wave modulation.

4. A circuit arrangement as claimed in claim 1, further comprising power control means for controlling the power consumed by the discharge lamp at a substantially constant value through the adjustment of the conduction period of the switching element.

5. A circuit arrangement as claimed in claim 1, wherein the converter comprises a bridge circuit including a second switching element in series with the first switching element.

6. A compact fluorescent lamp comprising:

a discharge vessel which is sealed in a gastight manner and transmits radiation, a housing connected to the discharge vessel and fitted with a lamp cap, wherein a circuit arrangement as claimed in claim 1 is present in a space enclosed by said housing.

7. A circuit arrangement as claimed in claim 3 further comprising means for controlling the power consumed by the discharge lamp by adjusting the on time conduction period of the switching element.

8. A circuit arrangement as claimed in claim 5 wherein each of the first and second switching elements is a field effect transistor having an inherent reverse diode which conducts a reverse current during a different part of each cycle of the high frequency current, a load circuit for the discharge lamp including, in series, an inductor, a pair of lamp connection terminals and a capacitor, and wherein said adjusting means controls the ratio of the field effect transistor forward conduction time ($T_{on}$) to its reverse diode conduction time in a cycle of the high frequency current.

9. A circuit for operating a discharge lamp comprising:

at least one input terminal for connection to a source of supply voltage for the circuit, a converter for producing a high-frequency alternating current at a frequency f and which comprises at least one controlled switching transistor coupled to said at least one input terminal and having a control electrode, a control circuit having an output coupled to the control electrode of said switching transistor for driving the switching transistor alternately into conduction and non-conduction at the frequency f, means for coupling a load circuit including at least an inductor and lamp connection terminals to said switching transistor, and circuit means coupled to said control circuit for producing low-frequency square-wave modulation of the power consumed by a discharge lamp when connected to the lamp connection terminals, said circuit means including means for adjusting the conduction period ($T_{on}$) of the switching transistor.

10. The lamp operating circuit as claimed in claim 9 wherein the switching transistor is a field effect transistor having an inherent reverse diode which conducts a reverse current during a part of each cycle of the high frequency current, and wherein said adjusting means controls the ratio of the field effect transistor forward conduction time ($T_{on}$) to its reverse diode conduction time in a cycle of the high frequency current.

11. The lamp operating circuit as claimed in claim 9 wherein said adjusting means controls the conduction period ($T_{on}$) of the switching transistor at a given fixed value of the high frequency current.

12. The lamp operating circuit as claimed in claim 9 wherein the circuit means switches the switching transistor via said control circuit between first and second lamp power levels at the low frequency square-wave modulation frequency while controlling the conduction time ($T_{on}$) of the switching transistor at the high frequency f.

13. The lamp operating circuit as claimed in claim 9 wherein the power consumed by a connected discharge lamp is maintained at a substantially constant value by adjusting the conduction period ($T_{on}$) of the switching transistor.

14. The lamp operating circuit as claimed in claim 9 wherein the converter further comprises a second controlled switching transistor connected in series circuit with the first switching transistor to said at least one input terminal and having a control electrode responsive to the output of the control circuit, and the load circuit is in parallel with the second switching transistor.

15. The lamp operating circuit as claimed in claim 9 wherein the switching transistor operates for a time period $\Delta$ T1 with a conduction period of $T_{on1}$ and operates for a time period $\Delta T_2$ with a conduction time $T_{on2}$.

* * * * *